United States Patent [19]

Gösswald

[11] 3,961,830

[45] June 8, 1976

[54] SALES DISPLAY, IN PARTICULAR FOR WATCHBAND TRANSPARENT PACKAGES

[75] Inventor: Fritz Gösswald, Peiting, Upper Bavaria, Germany

[73] Assignee: Eulit-Werk Staude & Co. KG, Peiting, Upper Bavaria, Germany

[22] Filed: Nov. 7, 1974

[21] Appl. No.: 521,641

[30] Foreign Application Priority Data

Nov. 26, 1973 Germany ..... 421019
July 2, 1974 Germany ..... 224412

[52] U.S. Cl. ..... 312/135; 312/107; 312/305

[51] Int. Cl.[2] ..... A47B 88/00; A47F 3/10

[58] Field of Search ..... 312/135, 125, 111, 107, 312/305

[56] References Cited

UNITED STATES PATENTS

| | | | |
|---|---|---|---|
| 489,705 | 1/1893 | Blackledge | 312/125 |
| 555,550 | 3/1896 | Yost | 312/135 |
| 1,298,822 | 4/1919 | Szold | 312/125 |
| 1,325,585 | 12/1919 | Schmidt, Jr. | 312/305 |
| 1,431,420 | 10/1922 | Preziosi | 312/305 |
| 1,565,993 | 12/1925 | Fitzpatrick | 312/107 |
| 2,194,238 | 3/1940 | Weaver | 312/135 |
| 2,543,263 | 2/1951 | Vanderveld et al. | 312/107 |
| 2,827,354 | 3/1958 | Wassell et al. | 312/107 |
| 3,102,609 | 9/1963 | Gerard | 52/656 |
| 3,856,147 | 12/1974 | Piretti | 312/108 |

FOREIGN PATENTS OR APPLICATIONS

| | | | |
|---|---|---|---|
| 277,157 | 12/1969 | Austria | 312/107 |
| 1,026,570 | 4/1953 | France | 312/107 |

*Primary Examiner*—Paul R. Gilliam
*Assistant Examiner*—Victor N. Sakran
*Attorney, Agent, or Firm*—Woodhams, Blanchard and Flynn

[57] ABSTRACT

Display device for merchandise. There is provided a plurality of rectangular boxes each having a sight window at one side thereof and each provided with an end opening for introducing merchandise into said box and withdrawing same therefrom. Each of said boxes has a projecting vertically aligned tongue at one corner thereof and projecting means defining a groove at a diagonally opposite corner thereof. A plurality of such boxes may be assembled together with the tongue of one being placed in the groove of another to provide a horizontal grouping of display units as desired. Same are then stacked vertically upon a base plate, preferably closed at the top with a cover plate and connected together by vertical tie rods extending between the base plate and the cover plate. The boxes may utilize spring means for holding the merchandise forwardly against the means defining the sight window and adjacent the entry and withdrawal opening or alternativey partitions may be provided within the box of less height than the merchandise to be received thereinto with openings at the end of each channel defined by such partitions. Thus, merchandise may be placed independently between each inner compartment and still viewed through the sight window.

15 Claims, 14 Drawing Figures

5
5
5
8
3
4
7
4
27
28
9
10
V
V
1
2
6
32

1
2
24
24
4
4
15
16
14
13
7
11a
1
9
11
4
B
L
B
15
16
14
13
12
26
30
29
32
24

IV
21
34
23
34'
25
27
20
28
22
21
23

16
21
15
30
29
24
21a
21
34
11a
a
27
33
11
35
26
18
21
17
19
14
13
21

23
22
31
24
23
26
a
21
20
30
25
21

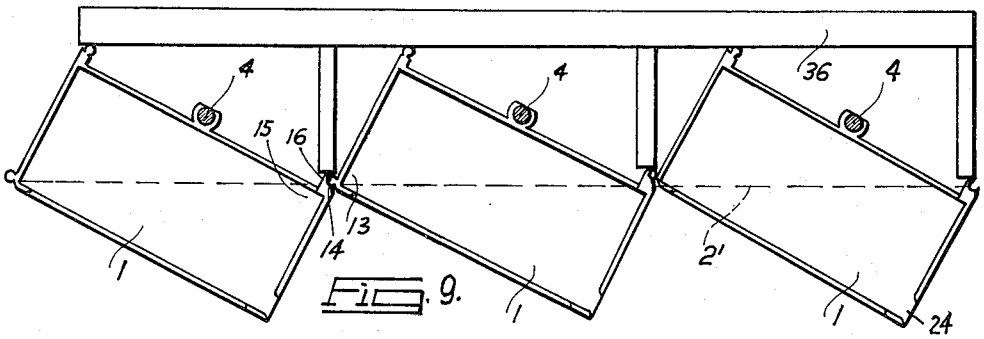
Fig. 9.
Fig. 6
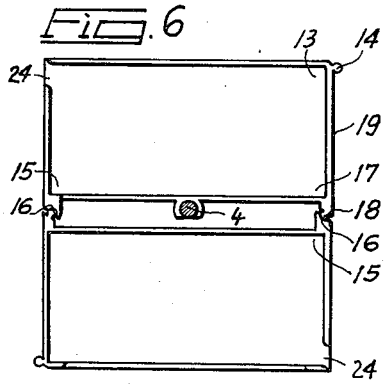
Fig. 7
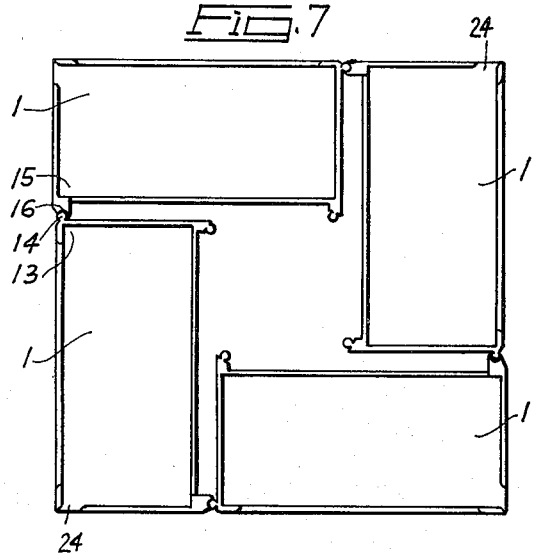
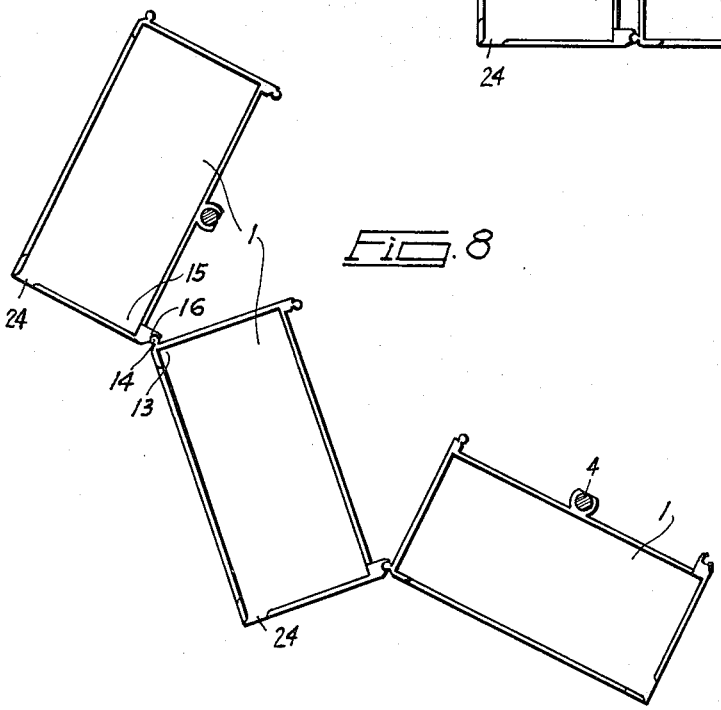
Fig. 8

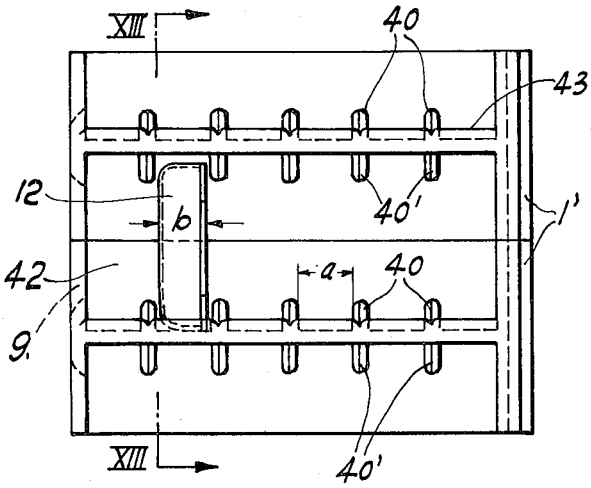
FIG. 12
FIG. 13
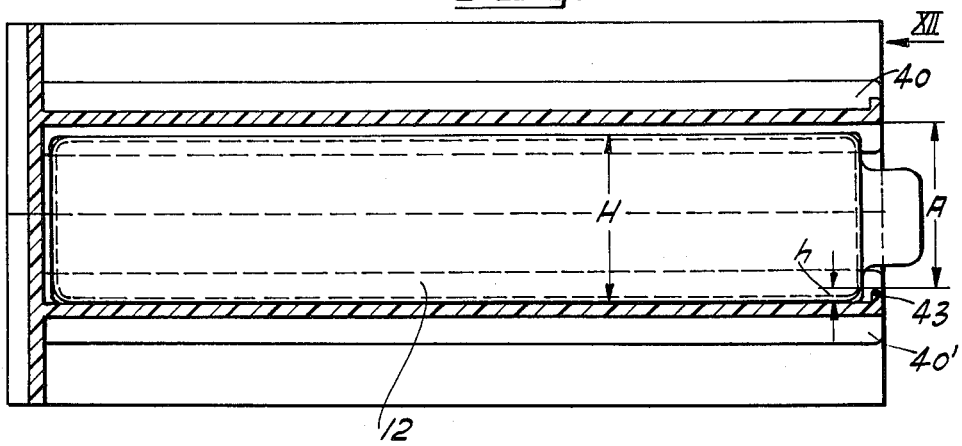
FIG. 14
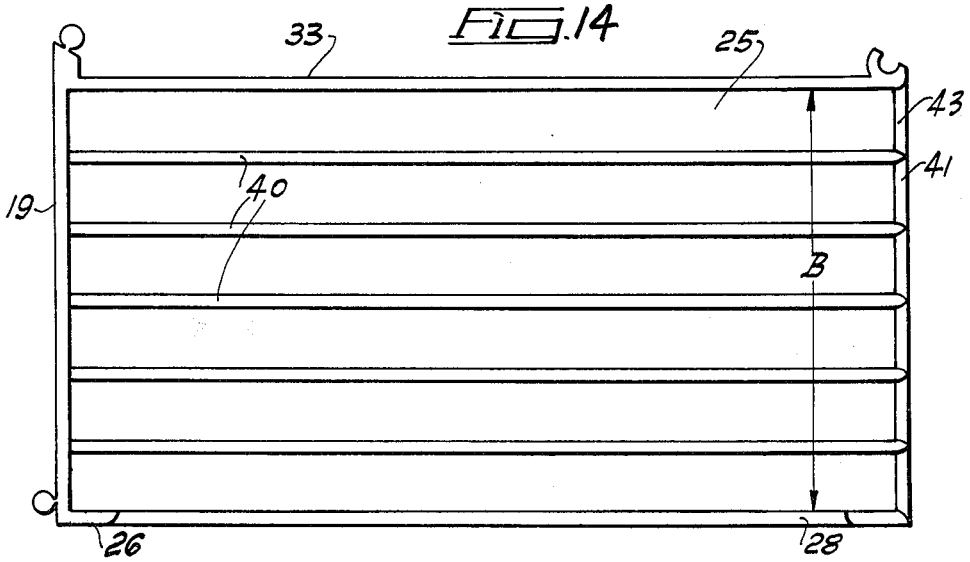

SALES DISPLAY, IN PARTICULAR FOR WATCHBAND TRANSPARENT PACKAGES

FIELD OF THE INVENTION

The invention relates to a sales display, in particular for transparent watchband packages, same having several similar, rectangularly shaped, individual structural units, which units are placed one on top of the other on a base plate and are held together by a cover plate and tie rods with respect to the base plate. Compartments are formed within said individual structural units, which compartments each has a sight opening on one side of the respective individual structural units and an opening from which the packages can be pulled on an adjoining outer end. In each level of a multi-level arrangement, there are arranged several such individual structural units and the individual structural units are connected among one another with the base plate and a cover plate.

BACKGROUND OF THE INVENTION

In one known sales display of this type, each level consists of four individual structural units which have a rectangular design and which form collectively in one plane a correspondingly larger rectangle with twice the edge length. Twelve keys are provided on one of the two outside sides of each individual structural unit, which keys are pressed downwardly against a spring force to release successive ones of the side-by-side arranged rectangular transparent packages containing watchbands of various widths which packages are then spring ejected sufficiently to be removed. The transparent package which appears at the sight opening permits a user to recognize the type of the watchbands contained in each individual structural unit. This sales display has the disadvantage that only one plan view form, namely a square or at most rectangular form, is possible.

SUMMARY OF THE INVENTION

The basic purpose of the invention is to improve the sales display, in particular for transparent packages of watchbands of the above-mentioned type so that it can be assembled of individual structural units which are simple to manufacture in as many as possible plan view forms to a columnlike structure.

This purpose is attained according to the invention by providing each individual structural unit with a vertical tongue having a round cross section on at least one corner and a corresponding groove with a round cross section on a diagonally located corner, which groove partly encloses the tongue of an adjacent individual structural unit. By reason of this unique design of the individual structural units, it is possible to assemble sales displays in a variety of plan view patterns, since the round cross-sectional shape of groove and tongue permits horizontal pivoting through a selected arc and with respect to each other of two adjacent structural components which are connected to one another by the tongue and groove means.

In addition to the form with four structural units on each level, further forms with five, six, seven, eight and theoretically still more structural units are possible. Sales displays with four, five, six, seven or eight outer corners are obtained with an increasing diameter of the arrangement which is ring-shaped in the largest sense. It is also possible to connect the individual structural parts parallel, however offset in the diagonal. The thus-formed sales help can then for example be suspended on the wall.

A particularly advantageous development of the inventive sales display consists in that each individual structural unit is divided by ribs into individual compartments each receiving a package, which ribs extend parallel to the sight opening and are arranged at a distance from one another corresponding approximately to the width of the packages, and has an opening which extends over the entire width of the individual structural unit perpendicularly to the sight opening, through which opening the packages can individually be inserted or withdrawn.

A further advantageous construction consists in a retaining strip provided in the region of the openings, which retaining strip extends perpendicularly to the ribs and from the bottom of the individual structural unit upwardly and has such a height that the distance between it and the underside of the floor of an individual structural unit arranged thereabove is larger than the height of a package. Due to their weight, the packages rest on the bottom of the individual structural unit and are secured against unintended slipping out by the retaining strips. This slipping out may for example occur if a rotatable sales display would be rotated too quickly or a nonrotatable sales display would be inclined during repositioning or rehanging. The retaining strip also prevents an unauthorized removal by the customer, or by children, because the removal is made slightly more difficult through the retaining strip, if one does not know of the existence of the retaining strip and its function.

BRIEF DESCRIPTION OF THE DRAWINGS

Further advantages and details of the invention will be described hereinafter in connection with several exemplary embodiments illustrated in the drawings, in which:

FIG. 6 to 9 are further possible plan view forms of the inventive sales display with various associations of the individual structural units for each level;

FIG. 12 is a side view of two superposed individual units in direction XII of FIG. 13;

FIG. 13 is a longitudinal cross-sectional view of two superposed individual structural units taken along the line XIII—XIII of FIG. 12;

FIG. 14 is a top view of an individual structural unit.

DETAILED DESCRIPTION

Figure 1:
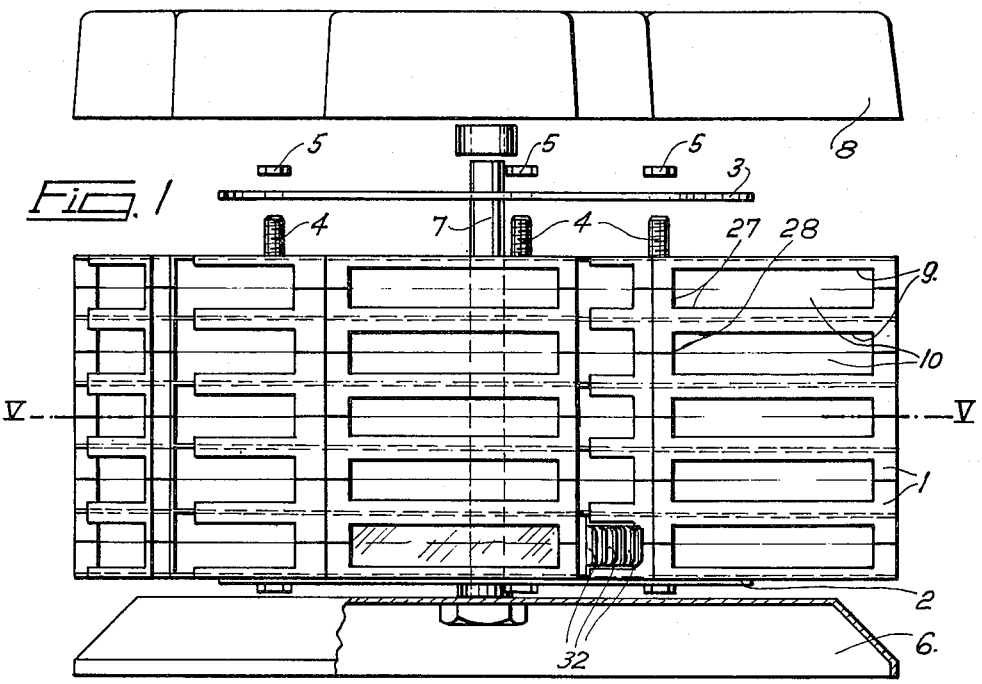
FIG. 1 is a front view of a rotatable sales display including six individual structural units with the cover plate and cover thereof being removed.
Figure 5:
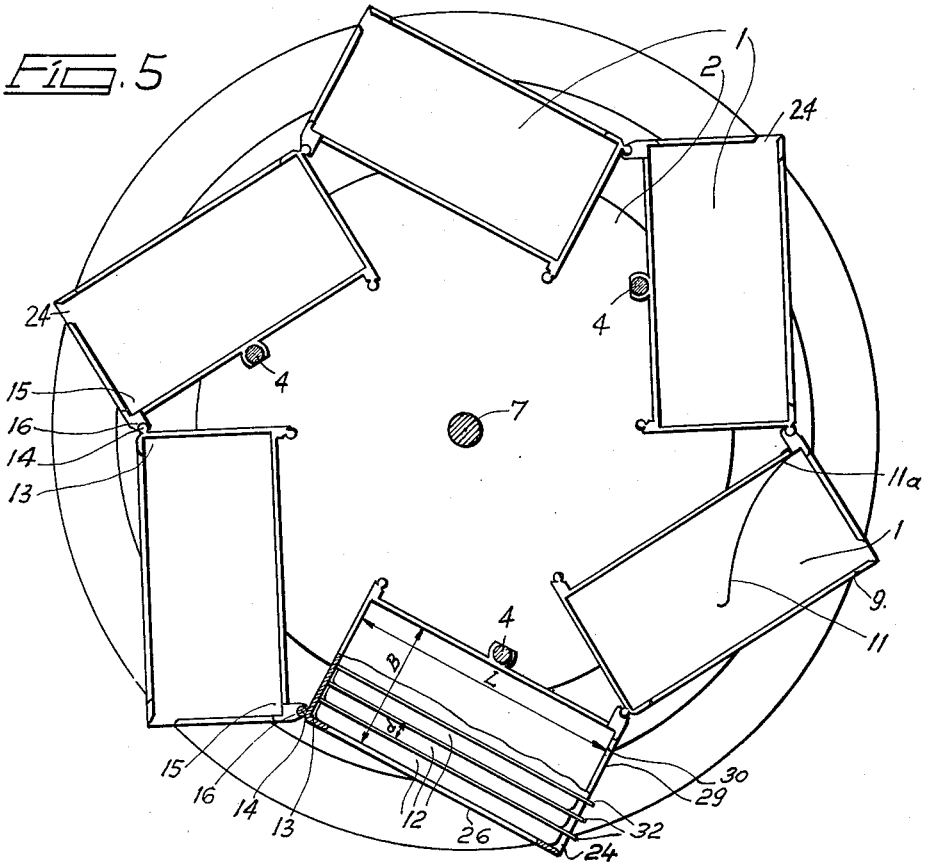
FIG. 5 is a horizontal cross-sectional view of a sales display along the line V—V in FIG. 1.

FIGS. 1 and 5 of the drawings illustrate a rotatable sales display for transparent packages containing watchbands, in which sales display six individual units 1 are provided in each level. They are placed one on top of the other in a column like fashion on a base plate 2 and are held together and on the base plate 2 by a cover plate 3 and tie rods 4. The tie rods 4 consist of screws having a length which corresponds approximately to the height of the sales display, said screws penetrating through both the base plate 2 and the cover plate 3 and being provided above each plate with nuts 5. The sales display is provided above with a cover 8 which is shaped to correspond to the shape of the plan view and can be rotated about a vertical center rod 7 secured on a base 6. Compartments 10 are formed with a sight opening 9 on the outside between the superposed similar rectangular individual units 1, from which compartments the transparent packages 12 which are urged against the outer compartment limit by the action of a spring 11 can be withdrawn through the opening 24.

Figures 2, 3, 4:
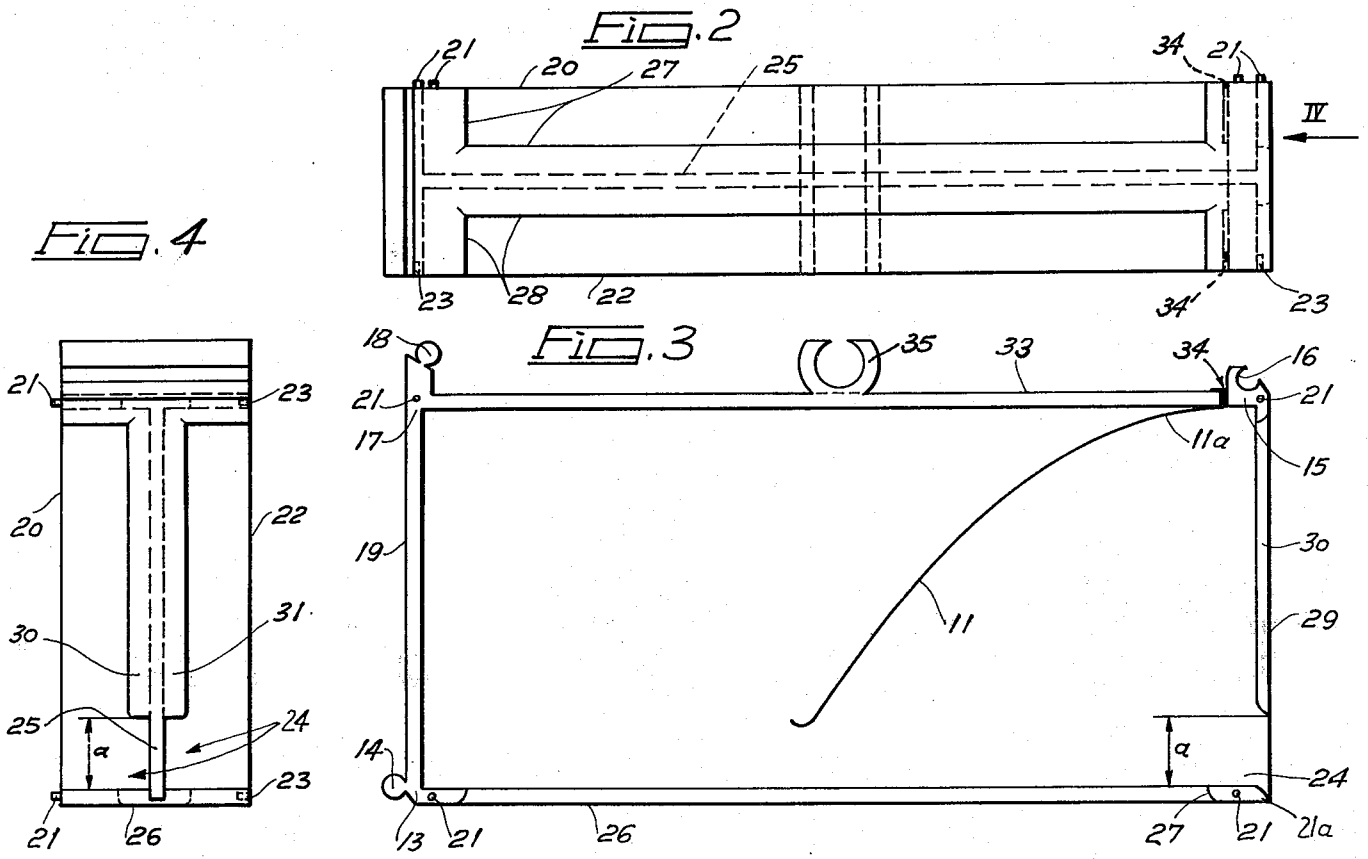
FIG. 2 is an outside view of one individual structural unit.
FIG. 3 is a top view of the individual structural unit of FIG. 2.
FIG. 4 is a side view of said structural unit in the direction of the arrow IV in FIG. 2.

As best shown in FIG. 3, each individual structural unit 1 has on at least one corner 13 a vertically extending tongue 14 having a round cross section and on the diagonally opposite corner 15 a corresponding groove 16 having a round cross section, which (compare FIG. 5 and FIGS. 7 to 9) partly embraces the tongue 14 of an adjacent individual structural unit 1. Due to the round cross section of groove 16 and tongue 14, the individual structural units 1 which are connected to said two elements can be pivoted with respect to one another through an arc of approximately 90°. Between the plan view form illustrated in FIG. 7 with four individual structural units per level and the form illustrated in FIG. 9 with individual elements arranged in series side-by-side with aligning diagonal, intermediate forms can be formed which have five, six (FIG. 5), seven or eight (FIG. 8) individual structural units 1 for each level. One is not, as in the known structure, confined substantially to one plan view form, but is able to form levels having various arrangements. Each individual structural unit 1 has advantageously on a further corner 17 a tongue 18 on the same side as the groove. Thus it is possible (see FIG. 6), to assemble sales displays which have only two individual units in one level. Aside from the larger quadratic plan view form shown in FIG. 7, this makes possible a smaller, mostly quadratic plan view form with only approximately two-thirds of the edge length of the square formed of four parts.

In the preferred embodiment which is illustrated in the drawings, each individual structural unit 1 is constructed rectangularly with two longitudinal sides 26, 33 (FIG. 3) and two narrow sides 19, 29 and the two tongues 14 and 18 are provided on the corners 13 and 17 of one narrow side 19. The length L (FIG. 5) of one structural unit corresponds approximately to the length of the transparent packages 12, while the width B corresponds approximately to six times the thickness *d* of one transparent package 12.

In order for the individual structural units 1 to be placed in a simple manner one on top of the other and in exact alignment, each individual structural unit 1, as shown in FIG. 2, has advantageously on its upper side 20 at least two vertical centering pins 21 and therebelow on the underside 22 corresponding centering holes 23. One centering pin 21 and one centering hole 23 are advantageously provided adjacent each corner 13, 15, 17, 21*a*.

The horizontal limits of the compartments 10 are provided advantageously of a plate 25 arranged in the plane of symmetry of each individual structural unit 1, and each structural unit 1 has rectangular recesses 27 and 38 for forming the sight opening 9 at the outer longitudinal side 26 on top and on the bottom thereof. The symmetric construction of the structural unit 1 which is manufactured of plastic simplifies on one hand the manufacture of the extrusion die, and on the other hand achieves a specially even flow of the plastic therethrough. As shown in FIGS. 3 and 4 and also indicated in FIG. 5, the plate 25 has advantageously an upper and lower retaining strip 30 and 31 on the outside of a narrow side 29, which retaining strips each terminate at a distance a from the outer longitudinal side 26, which distance is slightly greater than the thickness d of a transparent package 12. The retaining strips 30 and 31 are arranged on the plate 25 on the narrow side 29, which is opposite the narrow side 19 with the two tongues 14 and 18. The retaining strips 30 and 31 hold the packages 12 in their longitudinal direction in the compartment 10 (see also FIG. 5), with the exception of the frontmost package which is pressed against the parts defining the opening 9. Extensions 32 (FIG. 5) of the transparent packages 12 project between the retaining strips of two superposed individual structural units 1 slightly beyond the narrow side 29, which extensions are used to pull the respective frontmost package in its longitudinal direction through the opening 24 from the compartment. At least one vertical slot 34 for receiving an end 11*a* of a band steel spring 11 is provided advantageously at the inner longitudinal side 33 of the individual structural units 1, which band steel spring 11 presses the transparent packages 12 against the parts defining the sight opening 9. As can further be seen from the drawing, at least some of the individual structural parts 1 have advantageously at their inner longitudinal side 33 at least partial eyelets 35 for receiving vertical tie rods. These vertical tie rods can be formed by the above-described screws 4. If desired, the base plate 2 and the cover plate 3 can also have stops or profiles, against which the structural units of the lowermost or the uppermost level rest, so that the basic form is precisely determined.

In the embodiment which is partly schematically indicated in FIG. 9, the base plate 2' is arranged on a vertical wall plate 36 which can be hung on a wall. The three columns of the superposed individual structural units 1, which are connected with one another by the groove 16 and tongue 14, are clamped between the base plate 2' and the (not shown) cover plate by means of the screws 4. An upper cover includes here too the upper cover plate.

The sales display which can be assembled in a simple manner in various view patterns has compared with the conventional structure, aside from the many possibilities of variation, the still further advantage that only a few different parts are required.

Figure 10:
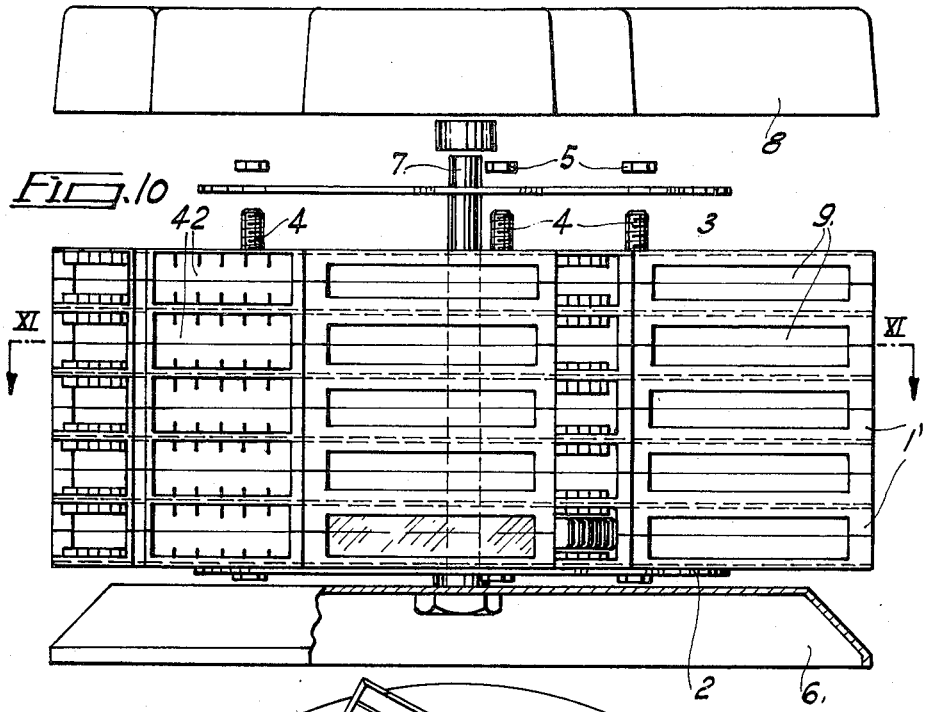
FIG. 10 is a front view of a further exemplary embodiment of a sales display having differently constructed individual units.
Figure 11:
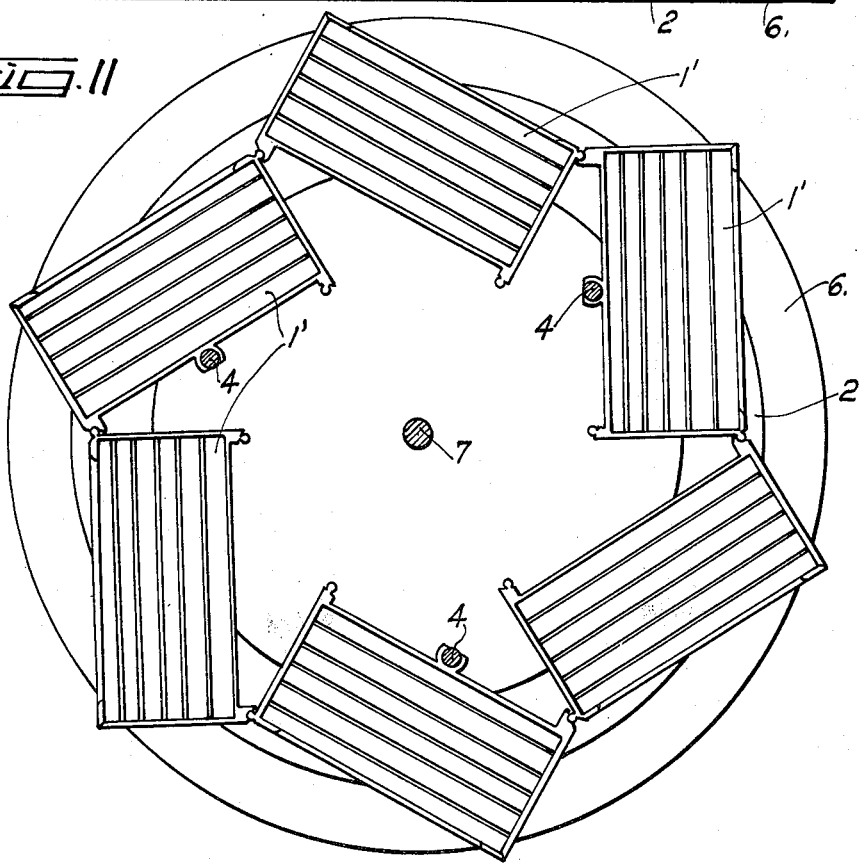
FIG. 11 is a cross-sectional view along the line XI—XI of FIG. 10.

FIGS. 10 and 11 of the drawings illustrate a further rotatable sales display for watchband transparent packages, in which, similarly as in the exemplary embodiment according to FIGS. 1 and 5, six individual structural units 1' are provided for each level. However, the sales display illustrated in FIGS. 10 and 11 has differently and especially advantageously constructed individual structural units 1'. Each individual structural unit has a plate 25 defining a base, from which extend both upwardly and downwardly an outer longitudinal side 26 (FIG. 14), an inner longitudinal side 33 and a narrow end 19. The outer longitudinal side 26 has a recess 28, by which the slight opening 9 is formed. The individual structural unit 1′ is divided into individual compartments by ribs 40 which extend parallel to the sight opening 9 or to the outer longitudinal side 26, each individual compartment being designated for receiving a transparent package 12. For this purpose the ribs 40 are arranged at distances a (FIG. 12), which is slightly larger than the width b of the transparent packages 12. The individual structural unit has an opening 42 which extends over its entire width B on its narrow side 41 which is opposite the narrow side 19, through which opening 42 the packages 12 can be moved into or removed from said individual compartments.

In order to achieve a good division into individual compartments, the ribs 40 and 40′ are provided advantageously in pairs extending upwardly and downwardly from the plate 25 of the individual structural unit 1′.

In order to save material, it is sufficient if the ribs 40, 40′ extend for only part of the height of an individual structural part.

The insertion of the transparent packages 12 is achieved by tapering the ribs 40, 40′ in a wedge-shaped manner at their end facing the opening 42, as can be seen in particular from FIG. 5.

A retaining strip 43 is provided near the opening 42, which retaining strip extends perpendicularly to the ribs 40 and upwardly from the plate 25 of the individual structural part 1′, the height *h* of said retaining strip being such that the distance A between it and the underside of the base of an individual structural unit 1′ arranged thereabove is greater than the height H of a package 12.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed all defined as follows:

1. In a display device having several similar rectangularly shaped individual structural units, said individual structural units being placed side-by-side and one on top of the other between a base plate and a cover plate and having compartments formed between at least a pair of said individual structural units one vertically stacked on the other, said compartments having a sight opening defined by a pair of vertically stacked individual structural units and a side opening from which a package can be removed on another perpendicularly adjoining outer side, said individual structural units being connected to one another and to said base plate and said cover plate, the improvement comprising wherein each individual structural unit has a vertically extending first tongue on at least one corner and a vertically extending groove on a corner which is diagonally opposite said first tongue, both said first tongue and said groove having a rounded profile with said groove partly enclosing said tongue of an adjacent individual structural unit to thereby define a hingelike connection between said side-by-side individual structural units to facilitate a change in angular relationship between said side-by-side stack of units without necessitating an alteration in the side-by-side connection therebetween.

2. The improvement according to claim 1, wherein each individual structural unit has an additional vertically extending second tongue being equilateral with the groove on a further corner located between said first tongue and said groove.

3. The improvement according to claim 2, wherein each individual structural unit has two longitudinal sides and two narrow sides, said first and second tongues being located at the opposite corners of one of said narrow sides.

4. The improvement according to claim 1, wherein the superposed individual structural units are held together in the vertical direction by several tie rods extending between said base plate and said cover plate.

5. The improvement according to claim 1, wherein each individual structural unit has on its upper side at least one vertical centering pin and therebelow on the underside a corresponding centering hole.

6. The improvement according to claim 5, wherein in the region of each corner of said individual structural unit there is provided said centering pin and said centering hole.

7. The improvement according to claim 3, wherein each of said compartments in each of said individual structural units has a horizontally aligned plate arranged in the plane of symmetry thereof and wherein each structural unit has rectangular recesses therein for forming the sight opening along the top and bottom of one of the outer longitudinal sides thereof.

8. The improvement according to claim 7, wherein said plate has an upper and lower horizontally extending retaining strip extending along an outside narrow side, said upper and lower retaining strips each terminating at a distance (a) spaced from one of said longitudinal sides, said distance being slightly larger than the thickness (d) of a package to be received in said compartment.

9. The improvement according to claim 3, wherein at least one vertical slot is provided in one of said longitudinal sides for receiving one end of a band spring, said band being comprised of spring steel and extends into said compartment to press the packages against the boundary of said sight opening.

10. The improvement according to claim 4, wherein at least some of the individual structural units have at least one eyelet on one of said longitudinal sides for engaging one of said vertical tie rods.

11. The improvement according to claim 7, wherein each individual structural unit has a plurality of parallel ribs thereon dividing the individual compartments into rows each adapted to receive a package, said ribs extending parallel to said sight opening and are arranged at a distance (*b*) spaced from one another corresponding approximately to the width (*b*) of a package, each of said compartments having said side opening therein which extends over the entire width (B) of the individual structural unit and is in a plane perpendicular to said sight opening and through which side opening packages can be individually inserted into or retracted from said compartment.

12. The improvement according to claim 11, wherein said ribs extend upwardly and downwardly in pairs on said horizontally aligned plate in said individual structural unit.

13. The improvement according to claim 12, wherein ribs extend only over a portion of the height of the individual structural unit.

14. The improvement according to claim 11, wherein said ribs are tapered wedge-shaped at their end facing said side opening.

15. The improvement according to claim 11, including a retaining strip provided in the area of said side opening, said retaining strip extending perpendicularly to said ribs and from said plate of each individual structural unit upwardly therefrom to a height (*h*) so that the distance (A) between the upper edge of said retaining strip and the underside of said plate of an individual structural unit arranged immediately thereabove is larger than the height (H) of a package.

* * * * *

UNITED STATES PATENT AND TRADEMARK OFFICE

CERTIFICATE OF CORRECTION

PATENT NO. : 3 961 830

DATED : June 8, 1976

INVENTOR(S) : Goesswald

It is certified that error appears in the above-identified patent and that said Letters Patent are hereby corrected as shown below:

Column 5, line 68; please delete "being equilateral with"

Column 6, line 1; please delete "the groove".

Signed and Sealed this

Nineteenth Day of October 1976

[SEAL]

*Attest:*

RUTH C. MASON
*Attesting Officer*

C. MARSHALL DANN
*Commissioner of Patents and Trademarks*